US011674292B2

(12) United States Patent
Brown et al.

(10) Patent No.: US 11,674,292 B2
(45) **Date of Patent: *Jun. 13, 2023**

(54) MODULAR PLUMBING BOX SYSTEM AND METHODS OF MOUNTING THE SAME

(71) Applicant: Oatey Co., Cleveland, OH (US)

(72) Inventors: Kenneth Brown, Columbia Station, OH (US); Aaron Lorkowski, North Ridgeville, OH (US)

(73) Assignee: Oatey Co., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/902,838

(22) Filed: Jun. 16, 2020

(65) Prior Publication Data

US 2020/0308811 A1 Oct. 1, 2020

Related U.S. Application Data

(63) Continuation of application No. 15/924,675, filed on Mar. 19, 2018, now Pat. No. 10,683,645.

(60) Provisional application No. 62/475,405, filed on Mar. 23, 2017.

(51) Int. Cl.
*E03C 1/02* (2006.01)
*E03B 7/09* (2006.01)

(52) U.S. Cl.
CPC ..... *E03C 1/021* (2013.01); *E03B 7/095* (2013.01); *Y10T 137/698* (2015.04)

(58) Field of Classification Search
CPC ..... Y10T 137/698; E03C 1/021; E03B 7/095
USPC ..... 248/57; 220/3.9–3.94
See application file for complete search history.

(56) References Cited

U.S. PATENT DOCUMENTS 4,165,443 A ‡ 8/1979 Figart
4,192,562 A ‡ 3/1980 Bishoff et al.
4,336,673 A ‡ 6/1982 Duchesne et al.
4,428,492 A ‡ 1/1984 Jorgensen
4,470,647 A ‡ 9/1984 Bishoff et al.
4,564,249 A ‡ 1/1986 Logsdon
4,612,412 A ‡ 9/1986 Sparth et al.
5,050,632 A ‡ 9/1991 Means, Jr.
5,965,844 A ‡ 10/1999 Lippa ..... H02G 3/14 174/48
6,057,509 A ‡ 5/2000 Simmons
(Continued)

*Primary Examiner* — Kevin F Murphy
(74) *Attorney, Agent, or Firm* — BakerHostetler

(57) ABSTRACT

A system of modular boxes as shown and described can be interconnected directly to one another via connectors that are integrally molded with the sidewalls of the boxes. The connectors of the boxes may include fastener receiving apertures for receiving a stud-mounting fastener therethrough. The connectors are thin and flexible, such that insertion and forcible tightening of a fastener through the aperture will cause a compressive force to be exerted between the interconnected boxes to maintain their spatial relationship and to maintain their interconnection. A further feature of the modular boxes of the system are anti-rotation members and receivers that are integrally molded to the side walls of the boxes. The anti-rotation members and receivers interact with one another at the point of connection between the boxes to prevent the boxes from flexing, rotating, or otherwise moving with respect to one another post-installation.

15 Claims, 12 Drawing Sheets

(56) References Cited

U.S. PATENT DOCUMENTS

| | | | | |
|---|---|---|---|---|
| 6,435,206 | B1 * | 8/2002 | Minnick | E03C 1/021 137/360 |
| 6,845,785 | B1 ‡ | 1/2005 | Condon | |
| 6,929,140 | B2 ‡ | 8/2005 | Rose | |
| 7,077,281 | B2 * | 7/2006 | Sato | H02G 3/10 220/806 |
| 7,100,999 | B2 ‡ | 9/2006 | Stravitz | |
| 7,360,553 | B1 ‡ | 4/2008 | Ismert | |
| 7,735,511 | B1 ‡ | 6/2010 | Ismert | |
| 7,854,337 | B1 ‡ | 12/2010 | Ismert et al. | |
| 9,185,975 | B2 ‡ | 11/2015 | Franklin | |
| 9,388,555 | B2 ‡ | 7/2016 | Whitehead et al. | |
| 9,394,674 | B2 ‡ | 7/2016 | Whitehead et al. | |
| 9,518,381 | B2 ‡ | 12/2016 | Whitehead et al. | |
| 10,683,645 | B2 * | 6/2020 | Brown | E03C 1/021 |
| 2015/0197923 | A1 ‡ | 7/2015 | Whitehead et al. | |
| 2015/0225930 | A1 ‡ | 8/2015 | Whitehead et al. | |
| 2016/0289930 | A1 ‡ | 10/2016 | Whitehead et al. | |
| 2016/0298319 | A1 ‡ | 10/2016 | Whitehead et al. | |

* cited by examiner
‡ imported from a related application

MODULAR PLUMBING BOX SYSTEM AND METHODS OF MOUNTING THE SAME

CROSS-REFERENCE TO RELATED APPLICATIONS

This application is a continuation application of U.S. patent application Ser. No. 15/924,675 filed on Mar. 19, 2018, which claims the benefit of U.S. Provisional Application No. 62/475,405 filed Mar. 23, 2017, the disclosures of which are incorporated by reference herein in their entirety.

TECHNICAL FIELD

The present disclosure relates to plumbing boxes for providing drain and/or water supply line access within a wall to facilitate attachment of the same to appliances, such as a laundry machine, ice machine, dishwasher, or the like.

BACKGROUND

Conventional plumbing outlet boxes are typically used as housings for connections to plumbing systems. A plumbing outlet box may be provided, for example, for connecting a washing machine to pipes running within the walls of a building that are designed to carry water (e.g., hot and cold water supply and drain connections). As another example, a plumbing outlet box may be provided to connect an ice maker of a refrigerator to a water supply. Plumbing outlet boxes are generally installed in the walls of a house or other climate-controlled building. Often more than one plumbing outlet box is needed in the same area, each with the capability of connecting to different appliances having different configurations and requirements.

Various improved laundry boxes have been developed, which include separating water supply lines and drain connections into separate boxes, as opposed to the conventional singular box that houses both supply and drain capabilities. Separated boxes are disclosed, for example, in U.S. Pat. No. 7,735,511 to Ismert, as well as in U.S. Pat. No. 9,394,674 to Whitehead and Humber. However, existing boxes are limiting in their modularity, are cumbersome to install, and can be prone to undesirable flexing and misalignment during installation (and post-installation).

Accordingly, there is a need for a modular plumbing box system whose arrangement and orientation can be freely customizable, which can easily accommodate different types of connections, which is easy to install, which resists flexing, and which maintains alignment after installation.

SUMMARY OF THE INVENTION

A modular plumbing box system according to a first embodiment of the invention may be configured for mounting to one or more studs within a wall. The system according to the first embodiment may comprise a first plumbing box, which has a top wall, a bottom wall, first and second side walls, and a back wall and an open front portion separated from the back wall by a central opening. The first plumbing box of the system may include a first connector that is integral with and which extends outwardly from the first sidewall. In some aspects, the first connector may extend continuously along the first sidewall from the top wall to the bottom wall, and the first connector may have a top surface and a bottom surface separated from the top surface by a thickness measured along a direction T. The first connector may be sized and configured to detachably connect with a second connector of a second plumbing box of the system so as to interconnect the first and second plumbing boxes.

In further aspects, the first connector of the first plumbing box may also include an anti-rotation projection that extends outwardly from the first connector at a location closer to the bottom wall than to the top wall. The anti-rotation projection may have a top surface that is coplanar with the top surface of the first connector, and the anti-rotation projection may have a bottom surface that is inset from the bottom surface of the first connector. The first connector of the first plumbing box may also include an anti-rotation receiver that extends outwardly from the first connector at a location closer to the top wall than to the bottom wall. The anti-rotation receiver may have a channel that is sized and configured to receive a portion of a second anti-rotation projection of the second connector of the second plumbing box of the system.

The modular plumbing box system according to the first embodiment may also include the second plumbing box, which is separately formed from the first plumbing box, and which is configured to be interconnected to the first plumbing box as described above and herein.

A modular box system in accordance with a second embodiment of the invention may also be configured for mounting to one or more studs within a wall. The system according to the second embodiment may have first and second separately formed boxes that each has respective first and second connectors. In some aspects, the first and second connectors may be integral with the first and second boxes respectively and the connectors are configured to mate with one another so as to interconnect the first box to the second box. In further aspects, the first and second connectors may each include a respective first and second plurality of fastener receiving apertures where each aperture of the first and second plurality is configured to receive a fastener therethrough and into the at least one stud. In still further aspects, the insertion of a singular fastener through any one of the apertures of the first or second pluralities may create a compressive force between the first and second boxes, such that the compressive force spatially retains the boxes relative to one another.

In other aspects of the first and second embodiments, each one of the first and second connectors may further include a projection member extending outwardly from each of the first and second connectors, and a projection receiver. The receiver may include an upper portion, a lower portion, and an open portion therebetween that defines a slot. The projection member may include a locking feature. In still further aspects, the slot of the projection receiver on each of the first and second connectors may be sized and configured to receive the locking feature of the projection member of the other one of the first and second connectors. When the slot receives the locking feature in this manner, the first box and the second box will be interconnected.

DETAILED DESCRIPTION OF THE DRAWINGS

The modular plumbing box system of the present invention, as shown and described herein, may comprise any number of individual modular plumbing boxes, such as one box or multiple boxes. Although a singular box may sometimes be desired in a given application, and the system of the present invention will allow for significant versatility for mounting the singular box, multiple box applications are more frequently employed. As will be described in greater detail herein, the multiple box system may be mounted and arranged in a variety of ways to suit the plumber or user installing the boxes within the wall adjacent to an appliance that the box(es) will service. For example, individual boxes of the multiple box system may be connected directly to one another in series within a stud bay or across a single stud or the boxes may be separately and individually mounted to the same, or a different, wall stud while not being directly connected to one another. This versatility allows the user to select the desired location for the modular plumbing box system within the wall without being constrained to the location of a singular stud for possible mounting arrangements.

Figure 1:
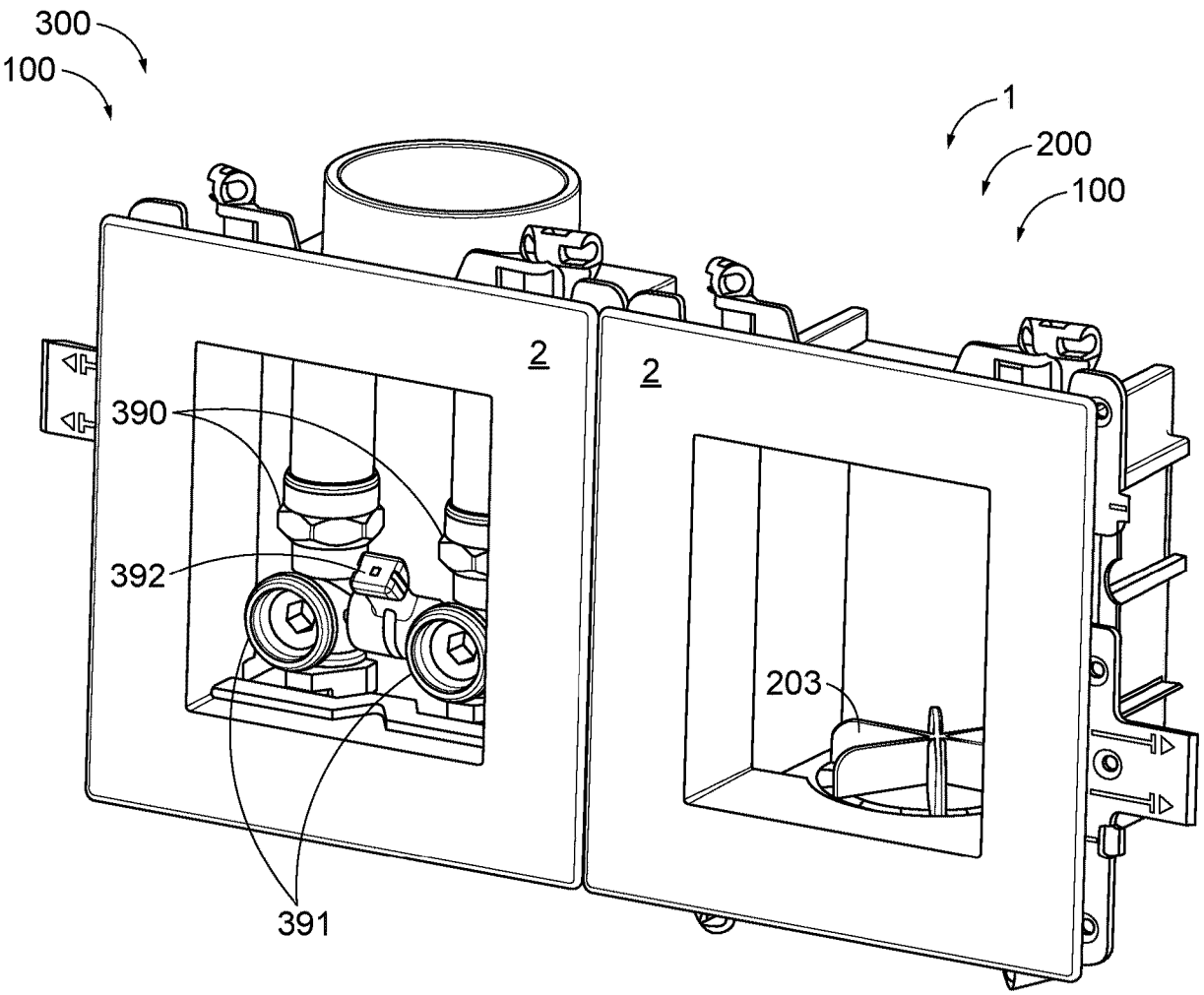
FIG. 1 is a front perspective view of a modular plumbing box system, according to an embodiment of the invention.

With reference to FIG. 1, a modular plumbing box system (1) is shown in accordance with a first embodiment. The system (1) may comprise, as shown, two modular plumbing boxes (100). The boxes (100) may be configured to be connected directly to one another in series (see FIG. 2 and description that follows) and they may house plumbing connections or ports that cooperate with various appliances to provide water supply, drain access, or both.

As shown in FIG. 1, the box (100) on the left is configured as a supply box (300), whereas the box on the right is configured as a drain box (200). The supply box (300) is characterized as such because it typically houses water supply lines, entering the box through two supply line openings (301, see FIG. 2), that terminate within the box in supply valves (390). As shown in FIG. 1, the supply box (300) contains two supply valves (390), which include threaded connectors (391) for interconnection of a supply hose to an appliance needing water supply. In one aspect, the two supply valves (390) may supply water of differing temperatures (such as hot and cold) or they may supply different fluids other than water, such as gas. Nevertheless, the supply valves (390) will also typically include a shut-off lever (392) that allows a user to quickly and seamlessly actuate so as to cutoff or resume supply of the water (or other fluid) through the threaded connections and to the resulting appliance receiving the water.

The drain box (200) in FIG. 1 can be readily identified (and distinguished from the supply box (300)) given the absence of supply line openings (301, see FIG. 2) within the drain box (200). Thus, the drain box (200) may be characterized by having a singular drain opening (201) within a bottom wall (102, see FIG. 2) of the box. As shown and illustrated in FIGS. 1 and 2, the drain opening (201) is surrounded on an exterior portion of the bottom wall (102) by a drain collar (202). The drain collar (202) extends outwardly from the bottom wall (102) and the collar (202) has a diameter that closely matches a diameter of the drain opening (201). The collar (202) facilitates the interconnection of a drain hose (not depicted) or the like to the drain box (200). The drain hose will carry drained fluid (such as water) deposited into the drain box (200) by an appliance, such as a laundry machine. One of ordinary skill will readily appreciate that the collar (202) may be necessary to secure attachment of the drain hose (not pictured), and that the collar (202) may be required to comply with plumbing codes, such as the Uniform Plumbing Code as promulgated by the International Association of Plumbing and Mechanical Officials ("IAPMO"). As shown in FIG. 1, the drain opening (201) may be fitted with a test cap (203) to facilitate testing of the line, or alternatively to seal off a drain opening (201) not being used, such as the opening (201) in the supply box (300) (which will be described in greater detail below). The cap (203) may come factory installed in the box or it may be installed separately by a user desiring to perform a testing operation on the drain connection or drain line after it has been connected to the drain box (200), or else by a user desiring to permanently seal the drain opening (201) which is inactive or not in use.

As shown in FIG. 1, the interconnected boxes (100) of the system (1) may be fitted with an aesthetic cover plate (2). The cover plate (2) may provide an aesthetically pleasing appearance to the boxes (100) and allow for a transitionary space between the portions of the drywall surrounding the boxes once the boxes are mounted in the wall. The cover plate (2) may be made of a single piece of molded material, such as PVC, plastic, metal, or any other desired material.

Figure 2:
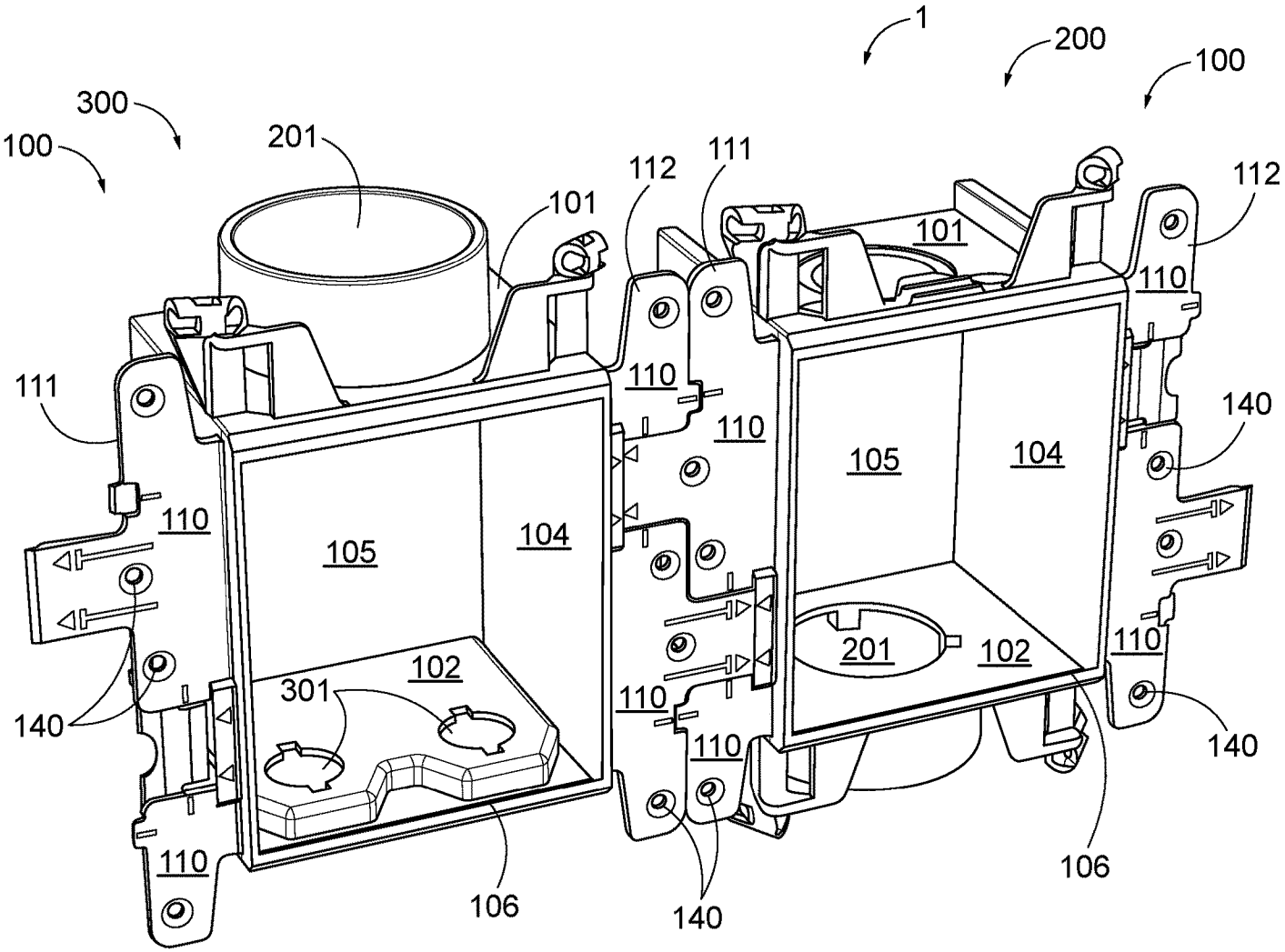
FIG. 2 is a front perspective view of a modular plumbing box system, according to an embodiment of the invention.

With reference now to FIG. 2, the system (1) of FIG. 1 is illustrated without the supply valves (390), test cap (203), or cover (2) to depict the features of the boxes (100). As shown, each modular plumbing box (100) comprises a box-shaped body including opposing top and bottom walls (101, 102) separated along a first direction by a height H, opposing side walls (or end walls) (103, 104) separated along a second direction substantially perpendicular to the first direction by a width W, a back wall (105), and an open front portion (106) spaced from the back wall (105) along a third direction that is substantially perpendicular to both the first and second directions by a depth D. The open front portion (106) allows a user access into an interior portion of the respective box (100) so that a user may, for example, actuate the shut-off level (392) (as shown in FIG. 1) or so that a user may clean or replace the hose connected from an appliance (not shown) one or multiple of the boxes (100). As shown in FIG. 1, the interior of the plumbing box includes a hollow space that is configured to accommodate connection of supply and/or drain lines from an appurtenant appliance. As described above, the supply box (300) shown on the left in FIG. 2 includes two supply line openings (301), although it is contemplated that in some applications the supply box (300)

may include any number of supply lines as necessary in a given application, such as one opening, two openings, three openings, or more. In such other applications, it is further contemplated that a width of the supply box (300), measured along the first direction, can be adjusted to be longer or shorter as needed to accommodate the additional supply lines extending through the openings (301).

As illustrated, both the supply box (300) and the drain box (200) may include a drain opening (201), although it is contemplated as well that embodiments of the supply box (300) may not include a drain opening (201). However, and as illustrated, the supply box (300) includes a drain opening (201) to provide additional latitude to a user desiring to locate the drain and supply within the same box. In such an application, the supply box (300) as illustrated would need to be rotated 180 degrees along an axis normal to the back wall (105) of the supply box (300) such that the drain opening (201), presently located in the top wall (101) of the supply box (300), would be oriented downwardly. And in such an application, after rotating the supply box (300) as described above, the water supply lines would enter the supply openings (301) through the top of the box (illustrated as bottom wall (102)). In addition to this application, one of skill will appreciate that the supply box (300) as illustrated in FIG. 2 could alternatively be used as a drain box (200) by sealing off the supply openings (301) using a cap or sealant material (not shown) and only utilizing the drain opening (201) to connect a drain hose/line to the box (300). For purposes of this detailed description, however, supply box (300) will hereafter refer to a box providing water supply only (and not drain connections) unless indicated otherwise.

Figure 3:
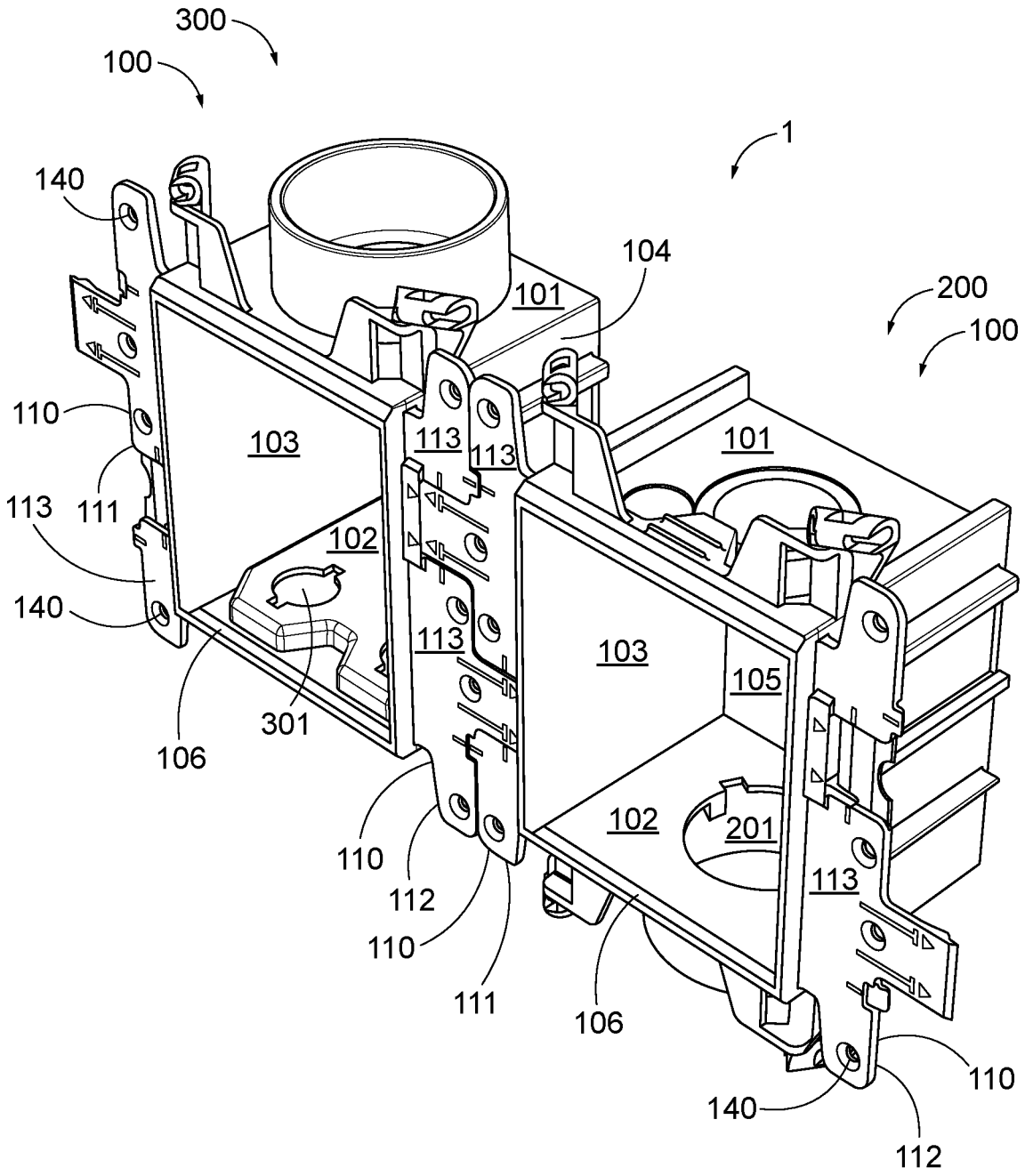
FIG. 3 is another front perspective view of the modular plumbing box system illustrated in FIG. 2.

With continuing reference to FIGS. 2 and 3, the boxes (100) of the system (1) are connected directly to one another via connectors (110). In that respect, and as shown, each box (100) will comprise two connectors (110): a first connector (111) and a second connector (112) that is complementary to the first connector (111) as will be described in greater detail below. Each of the connectors (110) are molded to (and are completely integral with) the side walls (103, 104) of each of the boxes (100, 200, 300). As shown in FIGS. 2 and 3, each of the connectors (110) is substantially flat, having a reduced, first thickness T1 as measured along the third direction. The connectors (111, 112) generally include a top surface (114*a*) and an opposed bottom surface (114*b*, see FIG. 8) spaced along the third direction by a distance equal to the first thickness T1. The connectors extend along an entire height of the box (100) measured in the second direction. In other words, the connectors (110) will extend along the sidewall from the top wall (101) to the bottom wall (102) of a given box (100). As shown in FIG. 2, the first and second connectors (111, 112) extend outwardly from their sidewalls (103, 104) along the second direction. When the boxes are interconnected as shown in FIG. 2, they are separated by a distance that closely matches the width of a standard wall stud, such as approximately 1.5 inches, although other widths and box separation distances are contemplated within the scope of the invention. Nevertheless, the closely matched spacing to the typical wall stud may facilitate attachment of the interconnected boxes (100) across the stud (a/k/a straddling the stud). However, one of skill in the art will readily appreciate that in certain applications, a user will interconnect the boxes (100) using the connectors (110) and mount them within the stud bay (i.e., between adjacent wall studs), wherein each box (100) (or alternatively only one of the boxes (100)) will connect individually to a single wall stud. This stud bay arrangement of the boxes (100) of the system (1) is described in greater detail below.

As noted, the connectors (110) of adjacent boxes (100) in the system (1) are shaped to complementarily mate with one another. More specifically, and referring to FIG. 5, which illustrates a single box (here, a drain box (200)) by itself, each of the connectors (110) is shown to include both a projection member (120) and a projection receiver (130). The projection receiver (130) of a first box (100) may be sized and configured to receive the projection member (120) of a second adjacent box (100) so as to interconnect the two boxes. With additional reference to FIGS. 5-9, the projection member (120) and projection receiver (130) are shown in greater detail. In this embodiment, the connector (110) includes a main body portion (113) that extends directly outwardly from the side wall (103, 104) of the box (100) along the second direction, and the projection member (120) extends generally outwardly from the main body portion (113) along the same second direction by a length having a first distance D1, measured in the second direction.

Figure 7:
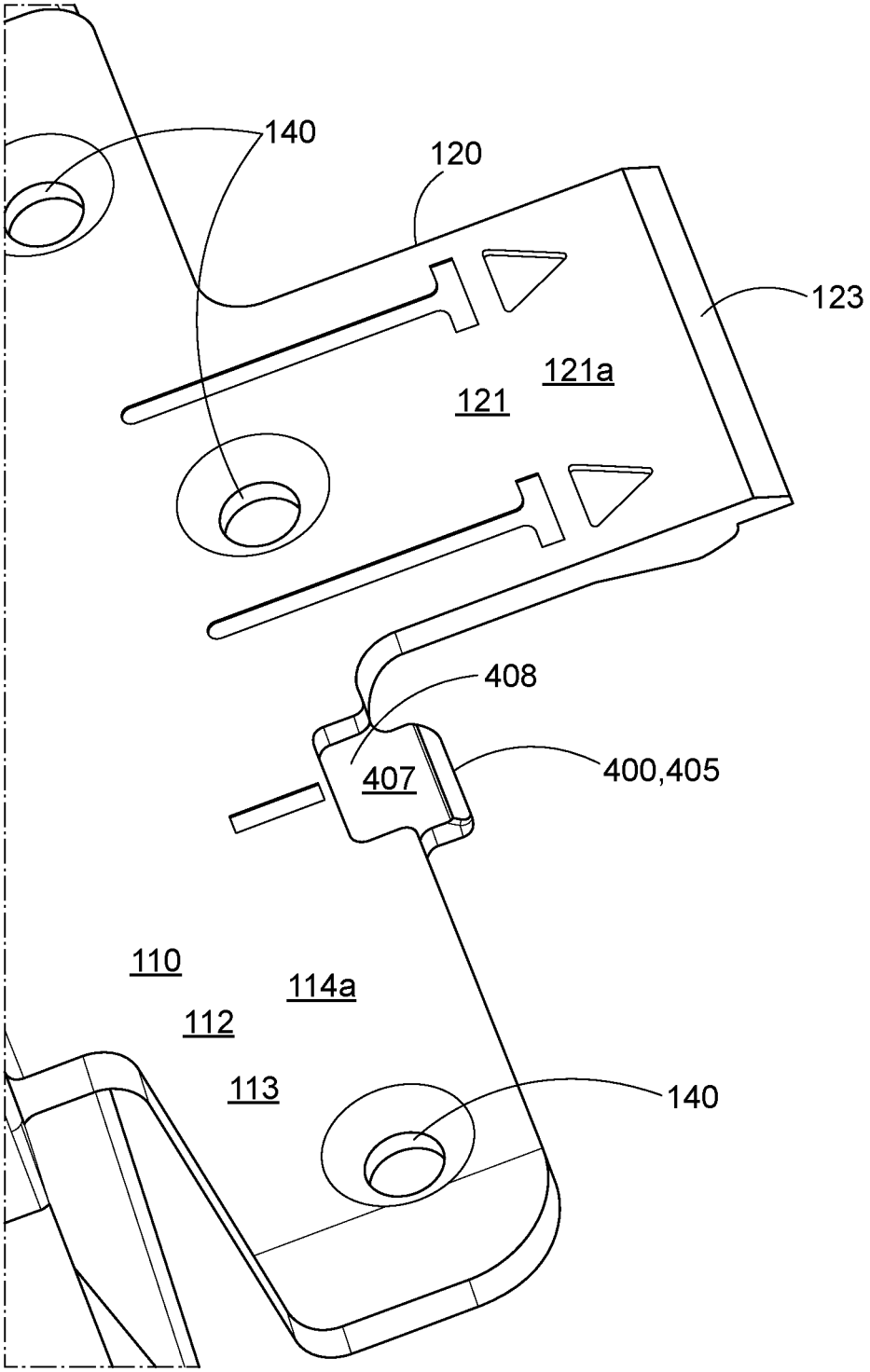
FIG. 7 is a detailed, zoomed perspective view of a front portion of the connector of the box illustrated in FIG. 6.
Figure 8:
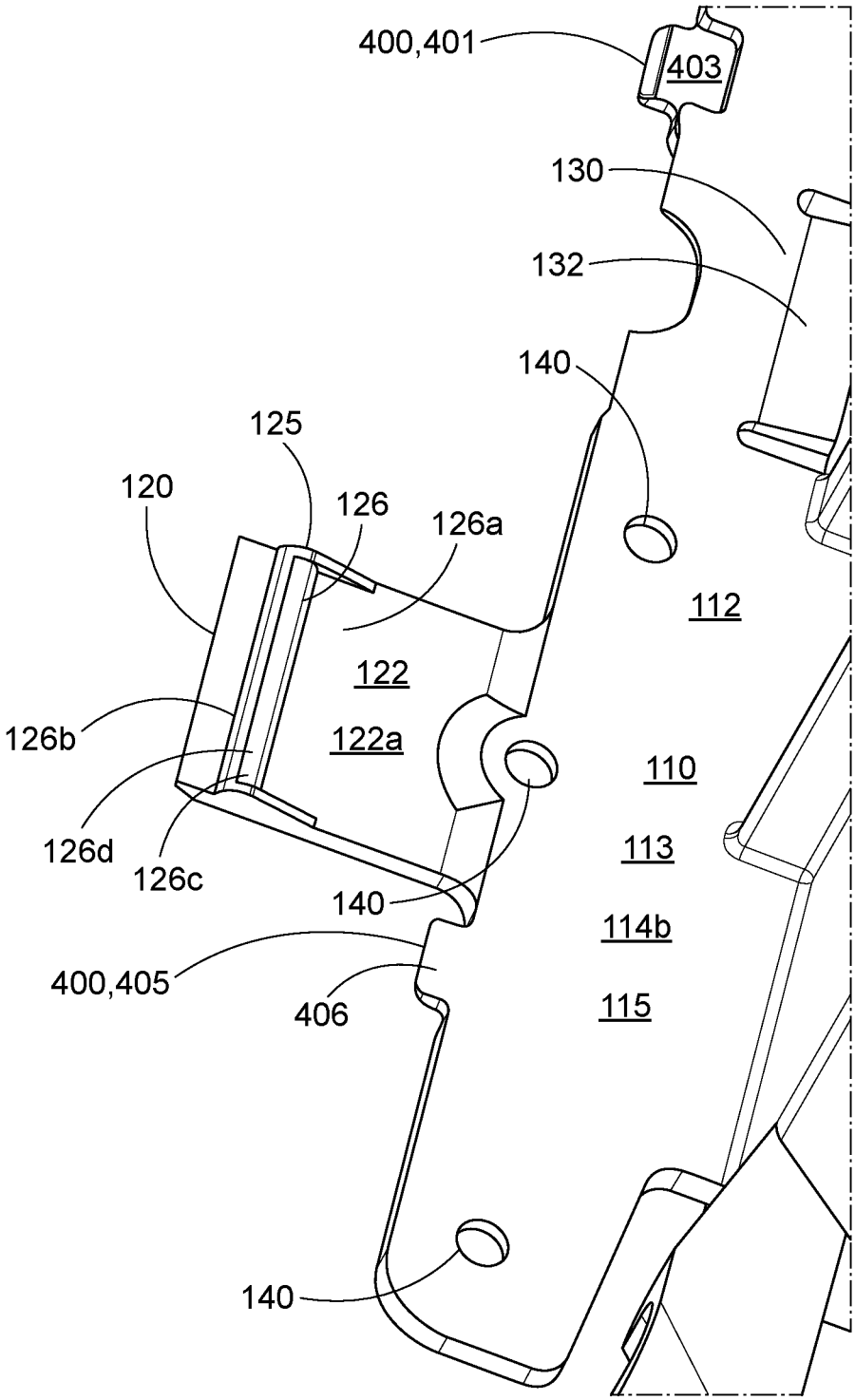
FIG. 8 is a detailed, zoomed perspective view of a rear portion of the connector of the box illustrated in FIG. 7.

As shown in FIGS. 7 and 8, the projection member (120) includes a top portion (121) and a bottom portion (122). The top portion (121) includes a first surface (121*a*) as shown, that is generally planar with an adjoining top surface (114) of the main body portion (113) of the connector (110), except that an outer edge of the top portion (121) includes a beveled edge (123). The projection member (120) may also have a width W1, measured in the first direction, between boundary edges of the top portion (121). The bottom portion (122) includes a second surface (122*a*) that is substantially flat and parallel to a bottom surface (115) of the main body portion (113) of the connector (110). The first surface (121*a*) and second surface (122*a*) are spaced from one another by a second thickness T2, where the second thickness T2 is less than the first thickness T1 associated with the connectors (110). In some embodiments, the projection member (120) may further include a transition region (124) that smoothly interconnects the bottom surface (115) of the main body portion (113) with the bottom portion (122) (and second surface (122*a*)) of the projection member (120). As shown, the transition region (124) may include a portion of a fastener receiving aperture (140) extending though the connector (which will be described in greater detail below). With continuing reference to FIGS. 7 and 8, the bottom portion (122) may further include a ridge locking feature (125) (or other suitable locking feature known in the art) that facilitates engagement with the projection receiver (130) as described in greater detail below. The ridge locking feature (125) as shown includes a ridge (126) projecting off of the bottom portion (122) in the third direction. The ridge (126) is defined by an inner ridge portion (126*a*), an outer ridge portion (126*b*), and a ridge top surface (126*c*) joining together the outer and inner portions (126*b*, 126*a*). At a maximum point of projection, the ridge (126) may define an apex (126*d*) on the ridge top surface (126*c*), and the apex (126*d*) may be spaced from the first surface (121*a*) by a third thickness T3. In some embodiments, the third thickness T3 may be substantially equal to the first thickness T1, although it is contemplated that variations between the thicknesses T1, T3 may be useful to vary the degree of force required to disconnect the boxes (100) once they are interconnected (as described in greater detail herein).

Figure 6:
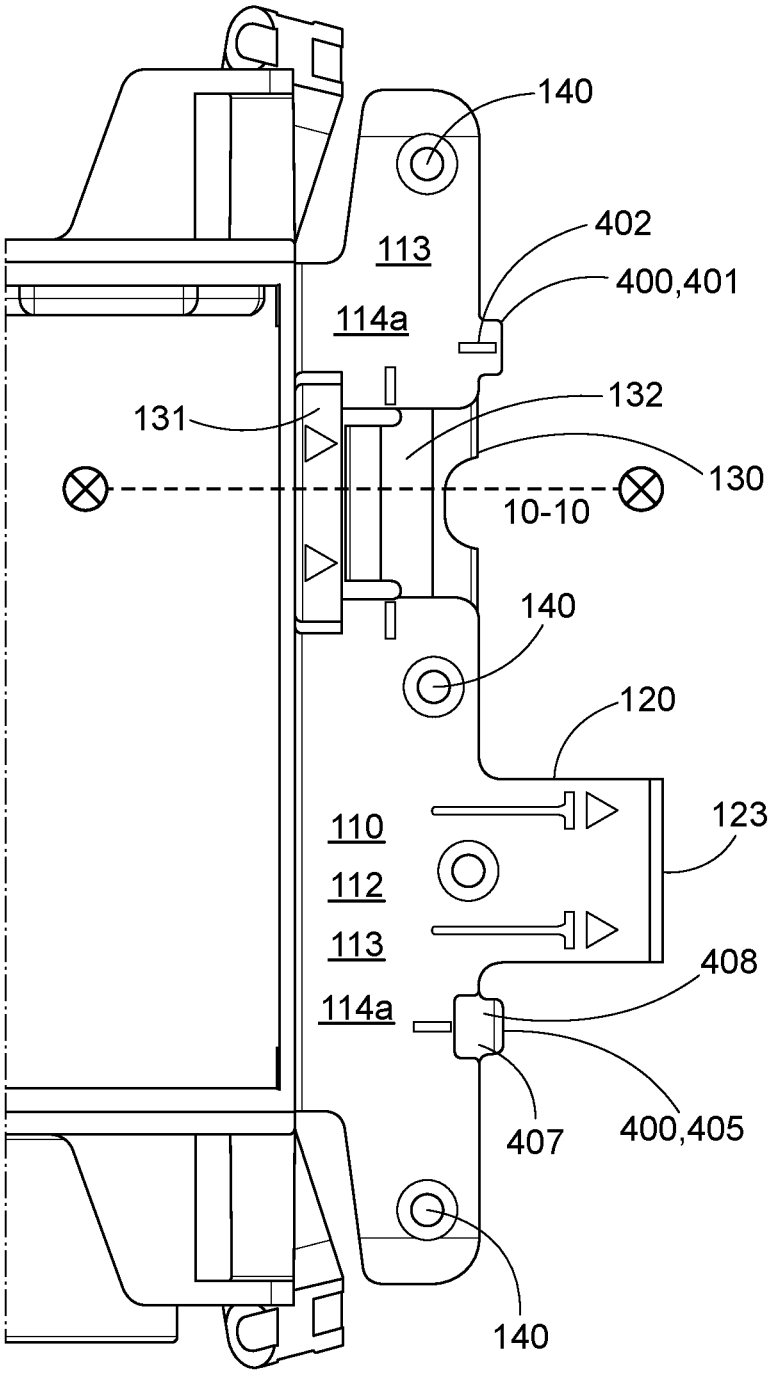
FIG. 6 is a detailed, zoomed frontal view of the modular plumbing box illustrated in FIG. 5, such zoomed view showing a connector of the box.
Figure 9:
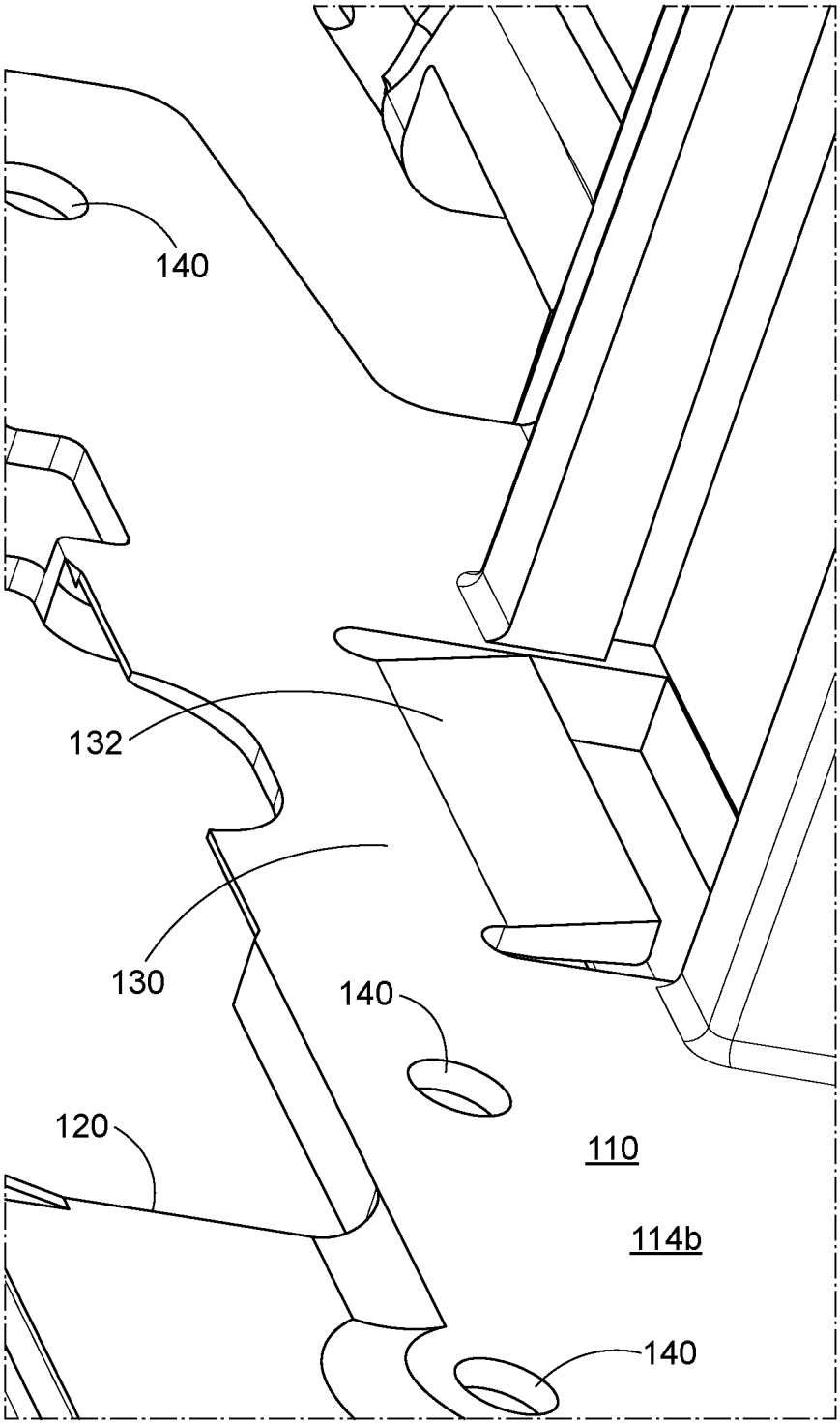
FIG. 9 is a detailed, zoomed perspective view of the rear portion of the connector of the box illustrated in FIG. 8, showing a different area of the rear portion.
Figure 10:
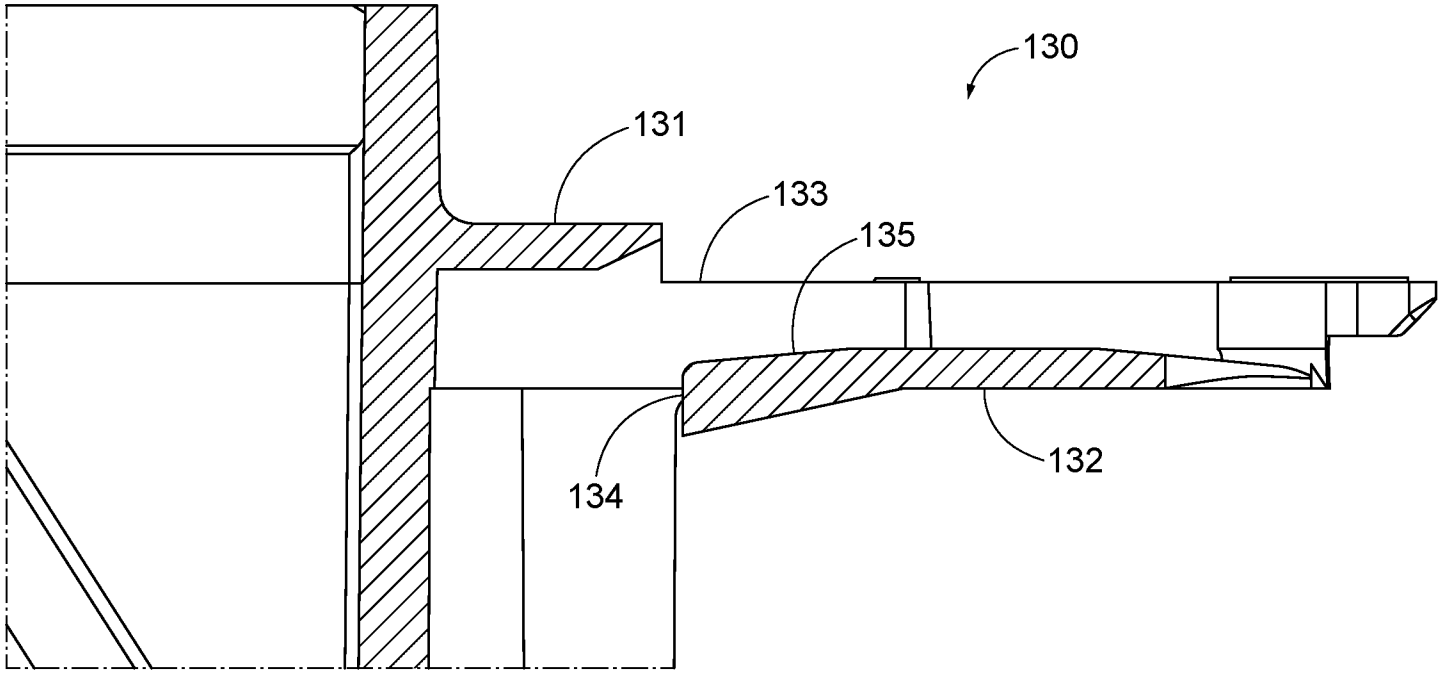
FIG. 10 is a cross sectional view of the connector of the box, taken along line 10-10 as illustrated in FIG. 6.

With reference now to FIGS. 6, 9, and 10, the projection receiver (130) includes an upper portion (131) and a lower portion (132). The lower portion (132) of the receiver (130) and the upper portion (131) of the receiver are separated by an open portion (133), as best shown in FIG. 10. The open portion (133) is configured to receive the projection member (120), and more specifically, to receive the ridge locking feature (125) of the projection member (120). The lower portion (132) of the receiver (130) has an inner edge (134) and a sloped upper surface (135) adjacent the inner edge (134). In operation, the ridge locking feature (125) of the projection member (120) will be inserted into the open portion (133) of the receiver (130) such that the ridge (126) will reside fully within the open portion (133). More particularly, when the projection member (120) is fully inserted into the projection receiver (130) so as to interconnect the two boxes (100), the inner ridge portion (126*a*) of the ridge (126) will abut the inner edge (134) of the lower portion (132) of the projection receiver (130). The abutment of these two features will prevent the two boxes (100) from becoming disconnected if force is applied along the second direction. Should a user wish to disconnect the boxes (100) after they have been interconnected as previously described, the user may rotate the boxes (100) slightly so as to lift the inner ridge portion (126*a*) of the ridge (126) of the projection member (120) above and beyond the inner edge (134) of the lower portion (132) of the projection receiver (130) so as to separate the member (120) from the receiver (130).

Figure 5:
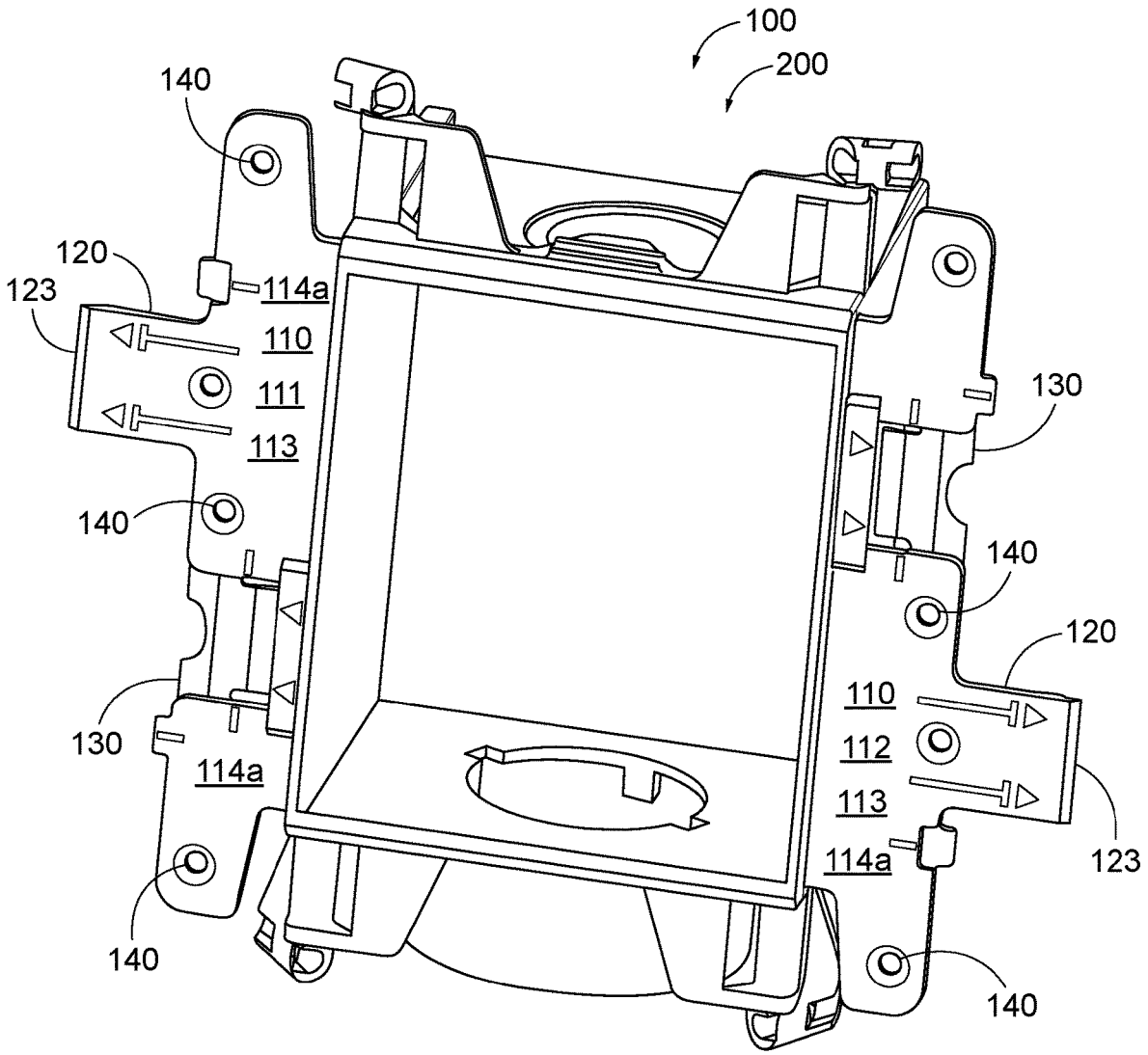
FIG. 5 is a front perspective view of a modular plumbing box according to an embodiment of the invention.

As shown more particularly in FIG. 5, and as mentioned above, each box (100) comprises two connectors (110), including the first connector (111) in the first side wall (103) and the second connector (112) in the second side wall (104). The first and second connectors (111, 112) are complementary to one another, such that the projection members (120) and projection receivers (130) of the first and second connectors (111, 112) have opposing configurations with respect to their location along the second direction (see, for example, how the opposing configurations enable connection of the boxes in FIG. 3). In other words, the projection member (120) of the first connector (111) is located closer to the top wall (101) than the bottom wall (102) and the projection receiver (130) of the second connector (112) is likewise (complementarily) located closer to the top wall (101) than the bottom wall (102). Likewise, the projection member (120) of the second connector (112) is located closer to the bottom wall (102) than the top wall (101) and the projection receiver (130) of the first connector (111) is likewise (complementarily) located closer to the bottom wall (102) than the top wall (101). Therefore, a first box, such as supply box (300) will always be able to interconnect to a second box, such as drain box (200) because the first and second connectors (111, 112) of each box are complementary and therefore interconnectable.

Figure 4:
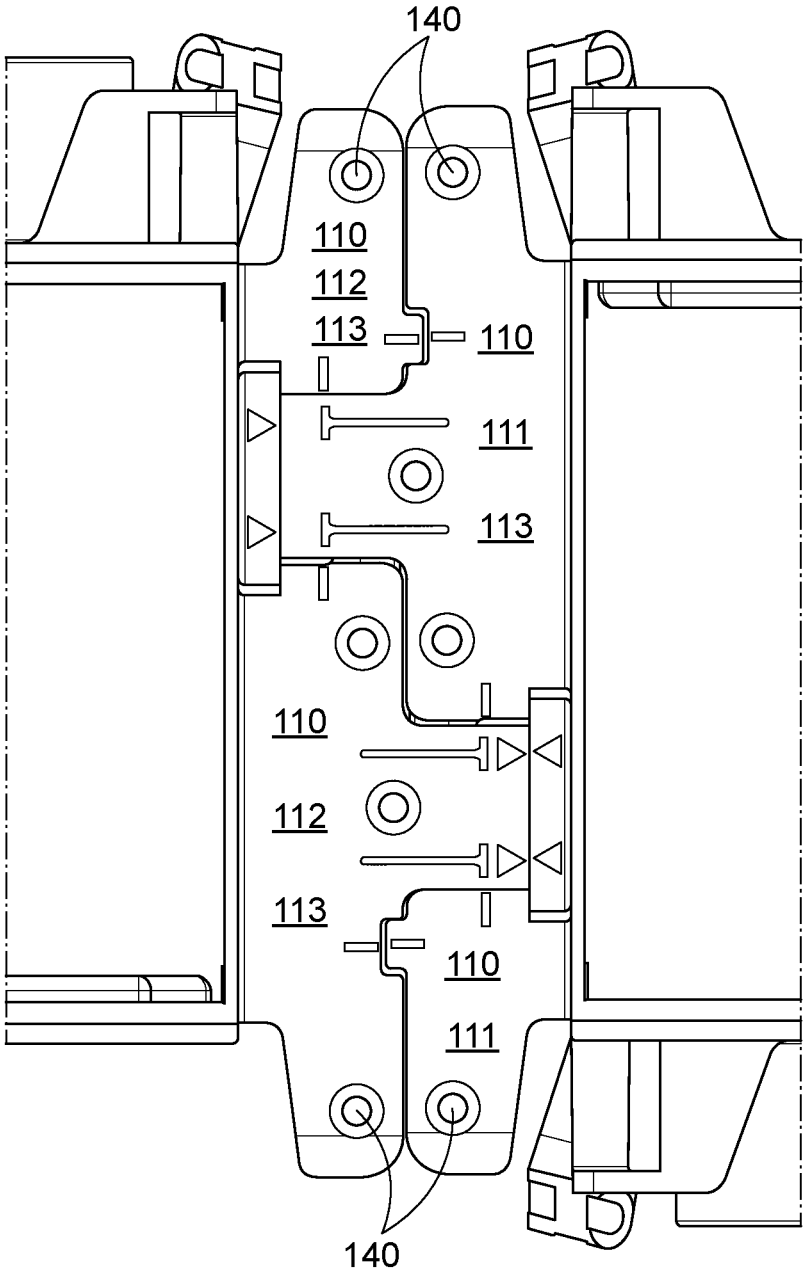
FIG. 4 is a detailed, zoomed frontal view of the modular plumbing box system illustrated in FIGS. 1-2, such zoomed view showing the connection between the boxes of the system.

With continuing reference to FIG. 5, the connectors (110) of the drain box (200) further include a plurality of fastener receiving apertures (140). The apertures (140) extend directly through the connectors (110) and are configured to receive a fastener (not pictured) such as a nail, screw, bolt, or the like. With reference now to FIG. 4, each of the first and second connectors (111, 112) may comprise 4 apertures (140), although one of skill will appreciate that any number of apertures may be implemented without departing from the scope of the invention. As shown, the apertures (140) of each of the boxes (100) do not overlap (or overlay) any portion of the adjacent box (100) when the boxes (100) are interconnected. When a modular plumbing box (100), such as the drain box (200) illustrated in FIG. 5 is to be mounted to a typical wall stud (not pictured), a user may, for example, arrange the drain box (200) adjacent to the stud such that the connector (110) of the side wall (103, 104) closest to the stud will overlap/overlay a front surface of the stud. When the drain box (200) is so arranged, the apertures (140) will also overlap/overlay the front surface of the stud such that a user may insert a fastener through the aperture (140) and directly into the stud beneath it, thereby fixably mounting the drain box (200) to the stud.

In an application when a user desires to mount two interconnected boxes (100) across a wall stud (i.e., a straddling arrangement, as described above), one of skill in the art will readily understand that the boxes (100) must ordinarily be interconnected first and mounted across the stud second. In existing box applications, a problem arises with boxes slipping with respect to one another or becoming misaligned when an interconnected pair of boxes was being mounted across a stud. The unfortunate result of such misalignment/slipping is a poorly mounted plumbing box (or series of boxes) which may be prone to leaks, connectivity problems with an appliance, or disengagement from an adjoining box (or from the stud) post-installation.

To address this problem, the boxes (100) of the present invention have been adapted such that inserting fastener into just one of the apertures (140) of just one of the boxes (100), once they are interconnected, will cause both boxes (100) to be immediately mounted securely to the wall stud, as well as to one another. As shown in FIG. 4, the singular fastener could be inserted in any of the apertures (140) of the second connector (112) of the left box (100) or any of the apertures (140) of the first connector (111) of the right box (100). Due to the substantially flat and planar nature of the connectors (110) of the boxes (100), insertion of a single fastener in this manner will cause a portion of the connector (111, 112) surrounding that single aperture (140) to deflect with respect to the adjoining and interconnected box (100). This deflection, albeit slight, creates a demonstrable compressive force between the boxes (100) of the system (1) exerted between the boxes (100) via the connectors (111, 112). By way of non-limiting example, once the projection member (120) is fully inserted into the projection receiver (130) so as to interconnect the two boxes (100), the compressive force may cause the ridge (126) of the member (120) to be driven more deeply (along the third direction) into the open portion (133) and toward the lower portion (132) of the projection receiver. By driving the ridge (126) more deeply as described, the boxes (100) will resist separation along the second direction. Alternatively, the compressive force may prevent the boxes (100) from rotating with respect to one another, which as previously described, might cause the boxes to detach from one another by disengaging the ridge (126) of the projection member (120) from the lower portion (132) of the projection receiver (130). In other words, the lack of rotatability of the boxes (100) will resist disengagement of the projection member (120) from the projection receiver (130) so as to keep the boxes interconnected.

This compressive force causes the boxes (100) to remain interlocked and interconnected, such as without the need for adhesives, additional mounting means, a support structure, user's hand, or plumbing tools, etc., while the remainder of the system is configured and mounted within the wall at a desired location. Another benefit is that the compressive force causes the boxes (100) to maintain their spatial relationship with respect to one another. Therefore, according to an embodiment of the present invention, a single fastener inserted through a single aperture (140) of the interconnected boxes can both 1) securably and positionally fixate two interconnected boxes (100) to one another, and 2) detachably mount the interconnected boxes across the wall stud. After the boxes (100) have been mounted in such fashion across the stud, additional fasteners may be inserted into the apertures (140) of both boxes to securably mount the interconnected boxes to the wall stud and to further compressively interconnect the boxes by imparting additional deflection to the connectors and thereby causing additional compressive, adjoining force.

As noted above, a problem also exists with existing plumbing boxes in that they are prone to external forces post-installation that may weaken the interconnection between the boxes. More particularly, after existing boxes are installed within a wall, the forces exerted on them by, for example, running water through supply lines or heavy-flow drain lines, may cause the boxes to flex or otherwise rotate with respect to one another in their mounted configuration. This flexion or rotation, although slight, may over time cause the boxes to become weakened or (in the worst scenario) completely disconnected from one another. Weakened or disconnected boxes are prone to failure and may result in serious plumbing problems, such as leaks or floods, which may cause extensive damage to the wall or surrounding area.

To combat this problem, the plumbing boxes (100) of the instant invention are equipped with features to resist the flexion and rotation imparted on the boxes (100) by external forces. With reference to FIGS. 6-8, each one of the connectors (111, 112) of the boxes (100) includes a pair of anti-rotation features (400). The anti-rotation features (400) include both an anti-rotation projection (401) and an anti-rotation receiver (405), which both extend off of the main body portion (113) of the connectors (111, 112) along the second direction. The degree of extension may define a second distance D2 measured along the second direction, where D2 is less than D1. As shown in FIG. 6, the projection (401) may have a top surface (402) that is coplanar with the top surface (114*a*) of the main body portion (113) of connector (112) and an opposed bottom surface (403) (see FIG. 8) having a thickness T2 therebetween. And as shown in FIG. 8, the anti-rotation receiver (405) may have a bottom surface (406) that is coplanar with the bottom surface (114*b*) of the main body portion (113) of connector (112) and an opposed top surface (407) (see FIG. 6) having a thickness T3 therebetween. As shown in FIG. 7, the anti-rotation receiver (405) may be inset from the top surface (114*a*) by a distance A1, where the distance A1 may be substantially equal to thickness T2, and as shown in FIG. 8, the bottom surface (403) may be inset from the bottom surface (114*b*) of the connector (111, 112) by a distance A2 that is substantially equal to A1. The projection (401) and receiver (405) may also have a width W2 as measured in the first direction between boundary edges of the inset portions on the bottom surface (403) of the projection (401) and on the top surface (407) of the receiver (405), where W2 is less than W1. In some aspects, the anti-rotation receiver (405) may define a channel (408) that is sized and configured to receive all or a portion of the anti-rotation projection (401). When the boxes (100) are joined together as shown in FIG. 4, the anti-rotation projections (401) of the left and right boxes (100) as shown will mate with the anti-rotation receivers (405) of the adjoining box (100). In the embodiment shown in FIG. 4, the anti-rotation projections (401) will rest within the inset portion of the anti-rotation receivers (405) and likewise, the anti-rotation receivers (405) will rest within the inset portion of the anti-rotation projection (401). One of skill in the art will appreciate that the projections (401) and receivers (405) will mate without the use of adhesives or the like, although adhesives (such as glue, fasteners, etc.) could be used if additional reinforcement is desired.

Figure 11:
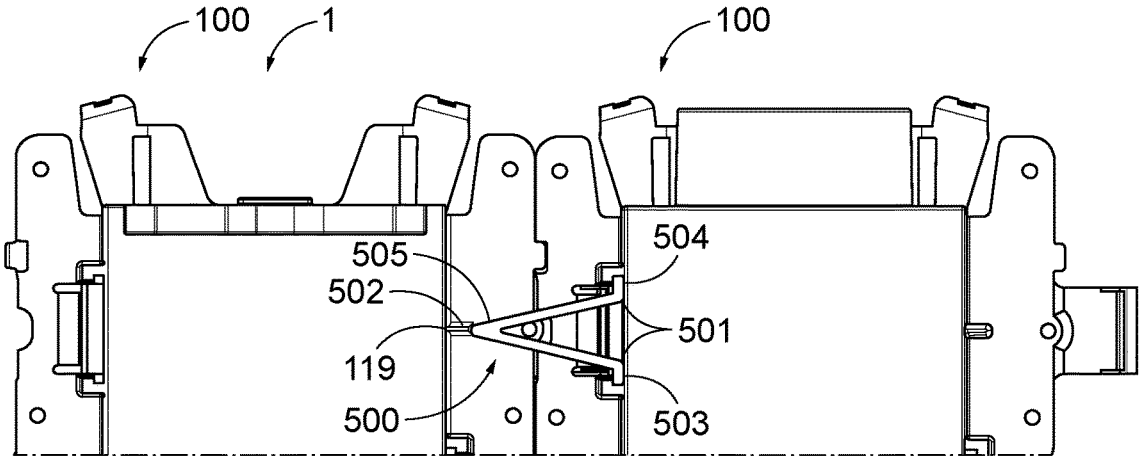
FIG. 11 is a rear view of a plumbing box system according to an embodiment of the invention.
Figure 12:
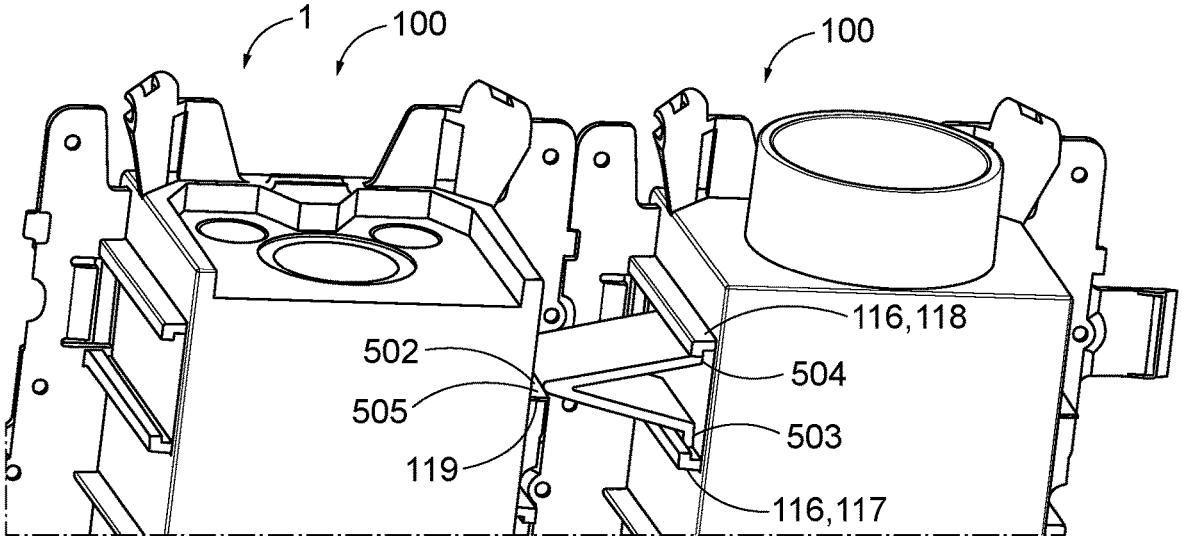
FIG. 12 is a perspective view of the plumbing box system illustrated in FIG. 11.

With reference now to FIGS. 11 and 12, the system (1) according to an embodiment of the invention may further include a spacer (500). The spacer (500) as illustrated in the FIGS. 11 and 12 is substantially V-shaped, but one of ordinary skill will readily understand that the spacer (500) may comprise any other shape, such as (for example) a T-shape. The spacer (500) generally includes a first end (or connection end) (501) and a second end (or abutment end) (502). The first end (501) includes at least one connector (503) that mates with a connection track (116) on the end wall (103, 104) of the box (100). As illustrated, the at least one connector may include first and second connectors (503, 504), which take the form of curved ends. The connection track (116) may likewise include first and second connection rails (117, 118), where the first connection rail (117) is configured to receive the first connector (503) and the second connection rail (118) is configured to receive the second connector (504). The second end (502) may include an abutment member (505) that abuts an abutment rail (119) on the adjoining box (100), shown on the left in FIGS. 11 and 12. As shown, the abutment member (505) is designed so as not to interconnect to the left-most box (100) as illustrated in FIGS. 11 and 12, but rather to abut the left-most box (100).

The spacer (500) is configured to be used in embodiments of the system (1) where the boxes (100) are not mounted across a stud in the wall, as described above. Rather, the spacer (500) is intended to be used in scenarios where the boxes (100) of the system (1) are mounted within a stud bay (i.e. in the space between adjacent wall studs). With existing boxes in such an arrangement, the boxes are prone to flexion, bending, and other distortion when exposed to external forces, such as those described above. Along with the anti-rotation features described above, the spacer (500) provides additional support in the stud-bay mounting application by preventing the boxes (100) of the present system (1) from rotating inwardly toward one another. Particularly, when external forces act on the boxes (100) once the spacer (500) has been inserted as described above, the abutment member (505) will abut the abutment rail (119) to prevent the boxes (100) from moving further toward one another along the second direction.

Figure 13:
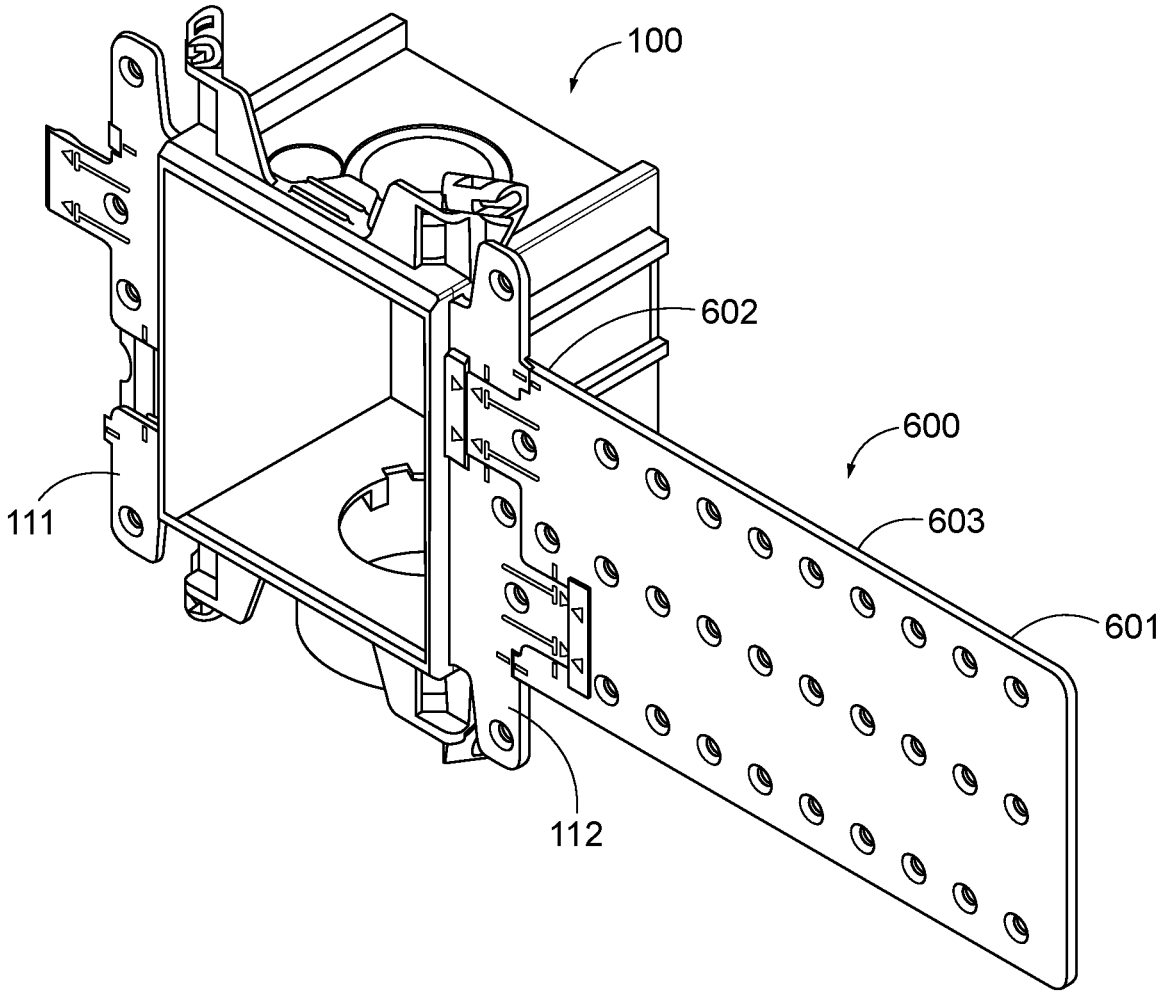
FIG. 13 is a perspective frontal view of a plumbing box according to an embodiment of the invention, the plumbing box being attached to an extension connector.

When the system (1) is mounted within the stud bay as previously described, at least one of the boxes (100) will connect directly or indirectly to an adjacent wall stud within the wall. With reference to FIG. 2, if the system (1) as shown is to be mounted immediately adjacent to a stud within the bay, where the stud is to be adjacent to the supply box (300), the first connector (111) of the supply box (300) will overlap/overlay the front surface of the stud and fasteners (such as nails or screws) will be inserted through the apertures (140) of the first connector (111) so as to secure the supply box (300) to the stud. If instead, however, the system (1) is to be mounted within the center of the stud bay (which in standard American homes can be between 16 to 24 inches wide), a user may need extension connectors (600) as shown in FIG. 13 to space a box an extended distance from an adjacent stud. With reference to FIG. 13, extension connectors (600) may comprise an elongate body having a stud (or wall) connection end (601) and a box connection end (602) separated by an extension piece (603). One of ordinary skill in the art will appreciate that the extension piece (603) may comprise any length as desired to space the box (100) from the stud (not pictured). The box connection end (602) may have a similar geometry to the first and second connectors (111, 112) so as to enable connection of the extension connectors (600) directly to the boxes (100) as described above with respect to box-to-box interconnection.

Although the foregoing description relates primarily to the use of plumbing boxes (100) for mounting supply lines and/or drain lines within a wall, one of ordinary skill will understand that the invention is not so limited to that application. The boxes (100) of the instant invention may, with slight modifications to the size and openings within the boxes (100), be utilized in other applications within a wall. Under such other applications, the openings of the boxes (100) could be re-sized, relocated, multiplied, or otherwise manipulated to allow for this further use. The modular concept as shown and described herein may be employed in such other applications without limitation.

What is claimed is:

1. A modular plumbing box system for mounting to one or more studs within a wall, the system comprising:

first and second separately formed boxes that have respective first and second connectors, the first and second connectors are integral with the first and second boxes, respectively, and the first connector of one of the first and second boxes is directly connected to the second connector of the other of the first and second boxes to detachably connect the first box to the second box, wherein each of the first and second boxes includes a pair of opposing sidewalls extending between a top wall and a bottom wall, wherein the first connector of each box extends outwardly from one of the sidewalls and the second connector of each box extends outwardly from the other sidewall, and wherein the first and second connectors continuously extend at least an entire height of the sidewall, and, wherein the first connector of each of the first and second boxes includes a first projection member having a first locking element and a first projection receiver, and the second connector of each of the first and second boxes includes a second projection member having a second locking element and a second projection receiver, wherein the first locking element of the first projection member of the first box is receivable by the second projection receiver of the second box to provide a first locking mechanism between the first and second boxes, and the second locking element of the second projection member of the second box is receivable by the first projection receiver of the first box to provide a second locking mechanism between the first and second boxes.

2. The system of claim 1, further comprising:

a spacer positionable between the first and second boxes when the first box is interconnected to the second box, the spacer including a connection end spaced from an abutment end, wherein the connection end of the spacer is attached to one of the first and second boxes and the abutment end abuts against the other of the first and second boxes.

3. The system of claim 1, further comprising:

one or more extension connectors that space at least one of the first and second boxes from the one or more studs, the one or more extension connectors having 1) a box connecting portion that detachably connects to the at least one of the first and second connectors, and 2) a stud connecting portion that detachably connects to the one or more studs.

4. The system of claim 1, wherein the first connector of each of the first and second boxes includes a first anti-rotation projection and a first anti-rotation receiver, and the second connector of each of the first and second boxes includes a second anti-rotation projection and a second anti-rotation receiver, wherein the first anti-rotation projection of the first box is received by the second anti-rotation receiver of the second box and the second anti-rotation projection of the second box is received by the first anti-rotation receiver of the first box when the first and second boxes are interconnected.

5. A modular plumbing box for mounting to one or more studs within a wall, the plumbing box comprising:

a pair of opposing sidewalls extending between a top wall and a bottom wall, a rear wall extending between opposing sidewalls and between said top and bottom walls, the top wall, bottom wall, rear wall, and both sidewalls define a cavity therewithin;

a first connector defining a first projection member, a first anti-rotation projection spaced apart from the first projection member, a first projection receiver, and a first anti-rotation receiver, the first connector extending outwardly from one of the sidewalls;

a second connector defining a second projection member, a second anti-rotation projection spaced apart from the second projection member, a second projection receiver, and a second anti-rotation receiver, the second connector extending outwardly from the other of the sidewalls, wherein the first and second connectors extend at least an entire height of the corresponding sidewall.

6. The modular plumbing box of claim 5, wherein the first anti-rotation projection extends from the sidewall a first distance and the first projection member extends from the same sidewall a second distance, and wherein the first distance is less than the second distance.

7. The modular plumbing box of claim 5, wherein the first connector includes a plurality of first apertures formed therethrough for attaching the first connector to a stud within a wall, the first apertures being spaced apart from the first projection member and the first projection receiver, and the second connector includes a plurality of second apertures formed therethrough for attaching the second connector to a stud within a wall, the second apertures being spaced apart from the second projection member and the second projection receiver.

8. The modular plumbing box of claim 5, wherein the first projection of the first connector includes a first ridge positioned adjacent to a distal end thereof, the first projection receiver includes a first slot, the second projection of the second connector includes a second ridge positioned adjacent to a distal end thereof, and the second projection receiver includes a second slot, wherein the first slot is configured to receive a second ridge of an adjacent modular plumbing box, or the second slot is configured to receive a first ridge of another adjacent modular plumbing box to interconnect two plumbing boxes.

9. The modular plumbing box of claim 5, wherein the first projection member is spaced apart from the first projection receiver on said first connector, and the second projection member is spaced apart from the second projection receiver on the second connector.

10. A modular plumbing system for mounting to at least one stud within a wall, the system comprising:

a first box and a second box, the first and second boxes formed separately and each box includes:

a pair of opposing sidewalls extending between a top wall and a bottom wall, a rear wall extending between opposing sidewalls and between said top and bottom walls, the top wall, bottom wall, rear wall, and both sidewalls define a cavity therewithin;

a first connector defining a first projection member and a first projection receiver, the first connector extending outwardly from one of the sidewalls; and a second connector defining a second projection member and a second projection receiver, the second connector extending outwardly from the other of the sidewalls; and wherein the first connector of both the first and second boxes includes a plurality of first apertures formed therethrough for attaching the first connector to a stud within a wall, and the second connector of both the first and second boxes includes a plurality of second apertures formed therethrough for attaching the second connector to a stud within a wall, and wherein at least one of the first apertures of the first connector of both the first and second boxes is spaced apart from the first projection member, and at least one of the second apertures of the second connector of both the first and second boxes is spaced apart from the second projection member; and wherein the first projection member of the first box is received in the second projection receiver of the second box and the second projection member of the second box is received in the first projection receiver of the first box to interconnect the first and second boxes.

11. The system of claim 10, wherein the first and second connectors of each of the first and second boxes extend at least an entire height of the corresponding sidewall.

12. The system of claim 10, wherein the first connector of both the first and second boxes further defines a first anti-rotation projection and a first anti-rotation receiver, and the second connector of both the first and second boxes further defines a second anti-rotation projection and a second anti-rotation receiver.

13. The system of claim 12, wherein the first anti-rotation projection of both the first and second boxes extends from the sidewall a first distance and the first projection member of both the first and second boxes extends from the same sidewall a second distance, and wherein the first distance is less than the second distance.

14. The system of claim 10, wherein the first projection of the first connector of both the first and second boxes includes a first ridge positioned adjacent to a distal end thereof, the first projection receiver of both the first and second boxes includes a first slot, the second projection of the second connector of both the first and second boxes includes a second ridge positioned adjacent to a distal end thereof, and the second projection receiver of both the first and second boxes includes a second slot, wherein the first slot of the first box is configured to receive a second ridge of the second box, and the second slot of the second box is configured to receive a first ridge of the first box to interconnect the first and second boxes together.

15. The system of claim 10, wherein the first projection member of both the first and second boxes is spaced apart from the first projection receiver on said first connector, and the second projection member of both the first and second boxes is spaced apart from the second projection receiver on the second connector.

* * * * *